US005655490A

United States Patent [19]

Nagano et al.

[11] Patent Number: 5,655,490

[45] Date of Patent: Aug. 12, 1997

[54] ROCKER ARM WITH ROLLER AND A METHOD FOR MANUFACTURING THE SAME

[75] Inventors: Shuji Nagano; Takashi Fujimoto, both of Kyoto; Takao Ichimura, Otsu; Hirokazu Komai, Kyoto; Kenji Takahashi, Kashiwara; Kazuo Uchida, Yamatotakada, all of Japan

[73] Assignees: Mitsubishi Jidosha Kogyo Kabushiki Kaisha, Tokyo; Koyo Seiko Co., Ltd., Osaka, both of Japan

[21] Appl. No.: 576,753

[22] Filed: Dec. 21, 1995

Related U.S. Application Data

[62] Division of Ser. No. 108,577, Sep. 3, 1993, abandoned.

[30] Foreign Application Priority Data

| | | | |
|---|---|---|---|
| Jan. 7, 1992 | [JP] | Japan | 4-820 |
| Sep. 30, 1992 | [JP] | Japan | 4-261749 |
| Sep. 30, 1992 | [JP] | Japan | 4-261750 |
| Sep. 30, 1992 | [JP] | Japan | 4-261751 |
| Sep. 30, 1992 | [JP] | Japan | 4-261752 |

[51] Int. Cl.[6] ..... F01L 1/18

[52] U.S. Cl. ..... 123/90.41; 123/90.42; 123/90.44; 74/519; 74/559

[58] Field of Search ..... 123/90.39, 90.41, 123/90.42, 90.44, 90.45; 74/519, 559

[56] References Cited

U.S. PATENT DOCUMENTS

| | | | |
|---|---|---|---|
| 2,926,645 | 3/1960 | Guarraia | 123/90.39 |
| 3,418,985 | 12/1968 | Hirose | 123/90.39 |
| 4,628,874 | 12/1986 | Barlow | 123/90.39 |
| 4,697,473 | 10/1987 | Patel | 123/90.39 |
| 4,799,464 | 1/1989 | Patel et al. | 123/90.41 |
| 4,825,717 | 5/1989 | Mills | 123/90.39 |
| 4,872,429 | 10/1989 | Anderson et al. | 123/90.44 |
| 5,010,857 | 4/1991 | Hempelmann et al. | 123/90.39 |
| 5,016,582 | 5/1991 | Mills | 123/90.39 |
| 5,048,475 | 9/1991 | Mills | 113/90.39 |
| 5,357,917 | 10/1994 | Everts | 123/90.39 |
| 5,372,097 | 12/1994 | Joseph et al. | 123/90.42 |

FOREIGN PATENT DOCUMENTS

| | | |
|---|---|---|
| 48-003762 | 2/1972 | Japan . |
| 64022801 | 2/1989 | Japan . |
| 1-166704 | 11/1989 | Japan . |
| 272310 | 10/1993 | Japan . |
| 2020389 | 11/1979 | United Kingdom . |

*Primary Examiner*—Weilun Lo

*Attorney, Agent, or Firm*—Birch, Stewart, Kolasch & Birch, LLP

[57] ABSTRACT

A rocker arm with a roller made with a metal plate and utilized in a valve actuating system of an engine is provided. The roller mounting rocker arm includes a rocker arm body (11) having a pair of side walls (11*c*) and a connecting portion 12 for connecting the side walls (11*c*), a roller (7) mounted between the side walls (11*c*), a pivot engageable recess (12*a*) formed on the connecting portion by drawing, and a valve stem receiving portion (14) formed at the other end of the side walls (11*c*). This roller mounting rocker arm has a high rigidity and is suitable for mass-production, and low cost is realized.

8 Claims, 16 Drawing Sheets

ROCKER ARM WITH ROLLER AND A METHOD FOR MANUFACTURING THE SAME

This application is a divisional of application Ser. No. 08/108,577, filed on Sep. 3, 1993, now abandoned, the entire contents of which are hereby incorporated by reference.

FIELD OF THE INVENTION

This invention relates to a rocker arm which is instrumental in opening and closing of the valves provided in the cylinder head upon receiving pushing force from the cam, and more particularly to a roller mounting rocker arm manufactured using a metal-shaping process and to a method for manufacturing the same.

BACKGROUND OF THE INVENTION

Typically, the main portion of a rocker arm (excluding a roller) is integrally made using a lost wax process or a hot molding process. These processes provide enough strength to the rocker arm, but are expensive.

Some rocker arms are mass-produced by press-molding a metal blank. This type of rocker arms is manufactured in such a manner that a metal plate is firstly blanked into the developed form of a rocker arm body having an opening in its center for mounting a roller; both sides of the opening being outwardly expanded as shown in FIGS. 34*a*-1, *a*-2 and *a*-3, then the expanded portions of both sides of the opening are downwardly folded to form side walls of the rocker arm body so as that the cross-section is an inverted U shape as shown in FIGS. 34*b*-1, *b*-2, and one end of the side walls are draw-processed and joined to each other to form a valve stem receiving portion. Further, downwardly pressing the joined end of the side walls while upwardly drawing the side walls to form a roller inserting portion as shown in FIGS. 34*c*-1, *c*-2 and *c*-3, then working the other end of the side walls into a shape corresponding to the pivot of the play adjuster to form a pivot engageable portion as shown in FIG. 34*d*-1, *d*-2 and *d*-3, and further making a hole on the outer walls of the roller inserting portion to provide a roller-supporting portion at which the roller is to be fixed with an axle.

However, in such a roller mounting rocker arm as described above, it is difficult to assure the precise working of both the valve stem receiving portion and the roller inserting portion, since these portions are integrally shaped by drawing and pressing the rocker arm body both upwardly and downwardly because of its form with inverted U-shaped cross-section, which process is rather more similar to cold-forming than one-piece metal molding. Further, the thickness of the rocker arm body is reduced during a cold-forming process with its complex steps, which results in decreased rigidity of the rocker arm.

Therefore, it is an object of the present invention to provide an improved rocker arm having enough rigidity and a high degree of freedom in design.

Further, simplification of each of the steps of the manufacturing process is desired, and so it is another object of the invention to provide a method for manufacturing a rocker arm which realizes an increase of productivity.

It is also desired to design a rocker arm so as to prevent interference with the moving elements and concentration of stress. And it is an another object of the invention to provide a rocker arm which can avoid stress concentration and has higher durability.

It is further an object of the invention to provide a roller mounting rocker arm which realizes a reduction of the processing cost.

It is still further an object of the invention to provide a method for manufacturing a metal-processed rocker arm body having a high rigidity and durability.

It is also an another object of the invention to provide a method for manufacturing a roller mounting rocker arm having high preciseness and being suitable for mass-production.

SUMMARY OF THE INVENTION

An rocker arm with a roller according to the present invention comprises a rocker arm body having a pair of side walls which are substantially parallel to each other with a predetermined space and a connecting portion which connects the side walls at at least one end of the side walls, a roller rotatably mounted between the side walls at the middle of the longitudinal direction, a pivot engageable recess which is formed on the connecting portion and upwardly projects toward the clearance between the side walls so as to receive a pivot, and a valve stem receiving element formed at the other end of the side walls.

The valve stem receiving portion of the rocker arm may be integrally formed with the side walls.

The valve stem receiving element is shaped by downwardly folding both ends of a metal plate so as to have an inverted U-shaped cross-section, and its inner corner in the longitudinal direction being round. The radius of curvature at the middle of the inner corners is set small enough but not to interfere with the valve stem. The radius of curvature at the ends of the inner corners may be greater than that at the middle of the inner corners.

The pivot engageable recess may be formed by drawing on the connecting portion.

At the connecting portion of the rocker arm, a planar face may be formed to surround the pivot engageable recess and between the side walls, by outwardly extending the side surface of the pivot engageable recess toward the side walls.

The inner edges of the side walls may be made round especially during the process of blanking the rocker arm body.

A hole may be provided on the respective side wall coaxially so as that an axle is inserted and fixed therein to rotatably support a roller. The axle can be fixed in such a manner that the end faces of the axle are fixed by caulking or the inner side diameter of the hole is designed smaller than that of the outer side of the hole.

The method for manufacturing a rocker arm according to the present invention comprises a step for blanking a metal plate into a shape consisting of two wing portions, each as a side wall, and a connecting portion to connect the side walls, a step for folding the wings so as that the two side walls become parallel with a predetermined space with a U-shaped cross-section, and a step for drawing the connecting portion into the clearance between the side walls to complete the rocker arm body.

The method for manufacturing a rocker arm according to the present invention further comprises a step for blanking a metal plate into a shape consisting of two wings having a hole each as a side wall and a connecting portion to connect the side walls, a step for folding the wings so that two side walls become parallel with a predetermined space having a U-shaped cross-section and the holes are substantially coaxial, a step for drawing the connecting portion into the clearance between the two side walls to form a pivot engageable recess thereon, a step for forming a value stem receiving portion at the other side of the clearance between the side walls, and a step for fixing a pin into the hole positioned in the middle of the side walls to rotatably support a roller.

Thus, according to the present invention, a rocker arm is provided which has high rigidity resulting from one metal plate processing, and is superior in terms of freedom of design. Especially when the valve stem receiving portion is integrally formed with the side walls, its productivity is increased.

Further, according to the invention, the valve stem receiving portion is shaped so as that its inner corners are round and the radius of curvature at the middle of the edges is set small, but not so small as interfer with the top face of the valve stem, and the radius of curvature at the ends of the edges is set greater than that at the middle portion, thereby, the concentration of stress caused by friction with the valve stem can be avoided and durability is maintained.

Rigidity and preciseness of the pivot engageable recess are also increased because this portion is formed at the connecting portion of the rocker arm by a drawing process.

Besides, because of the planar face provided surround the pivot engageable recess and between the side walls by outwardly drawing the side surface of the pivot engageable recess toward the side walls, distortion caused by a heating process is almost constant at any point of the surroundings of the pivot engageable recess, which allows it to keep the precise spherical formation and to receive the pivot with surface-to-surface even contact. Thereby, pressure and friction between the pivot and the recess can be restrained.

Roundness of the inner edge of the side walls can reduce the friction resistance and prevent damage of the roller even in the case that the roller touches with the side walls. Since the inner edges of the side walls are made round during the initial blanking process, manufacturing cost is kept lower.

The manufacturing cost can also be kept lower by providing a hole on the side walls at the initial blanking process, into which an axle is inserted and fixed to support a roller. Especially when the axle is fixed by caulking, both the cost and the weight are reduced, while when the hole is formed such that the outer diameter of the hole is greater than the inner diameter, the axle can be firmly fixed in it and does not slip off from the roller supporting position.

According to the foregoing manufacturing method of a roller mounting rocker arm with a roller, productivity is improved and a rocker arm body with high rigidity and durability can be obtained.

Further, according to the above method, a light and rigid rocker arm can also be obtained which is suitable for mass-production.

PREFERRED EMBODIMENTS

Figure 1:
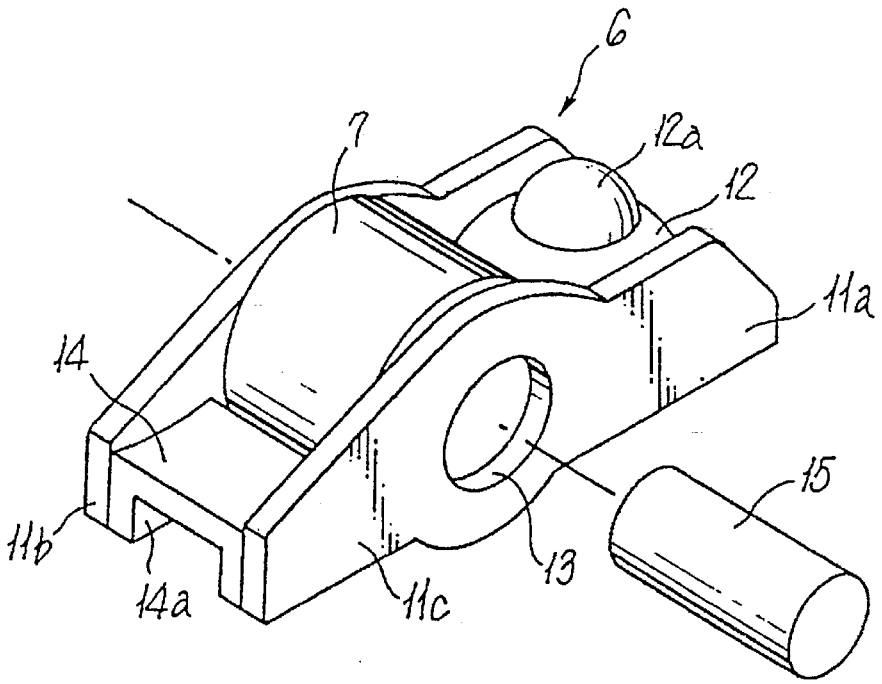
FIG. 1 is a perspective view of a roller mounting rocker arm according to the first embodiment of the invention.
Figure 33:
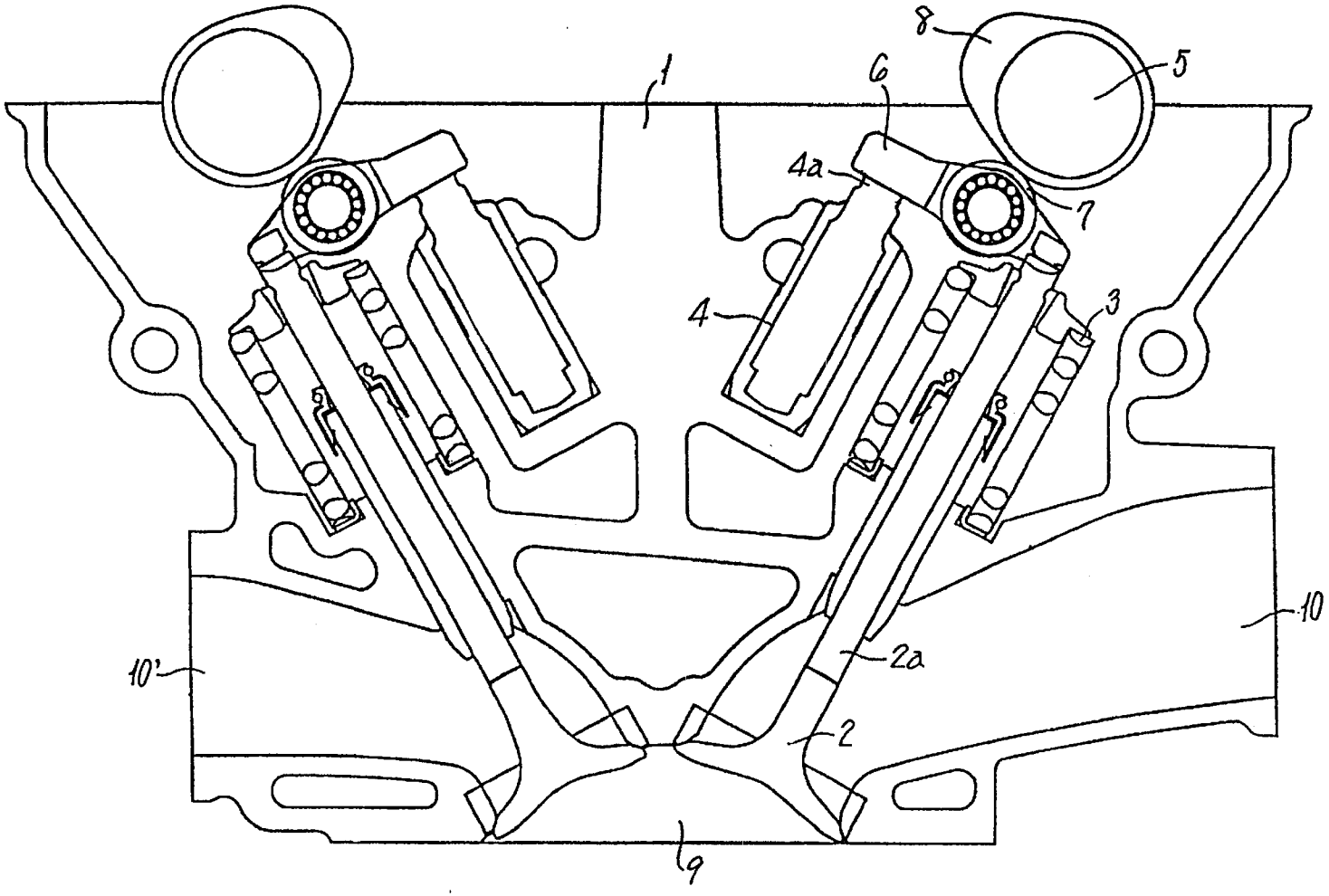
FIG. 33 shows a valve actuating mechanism in which metal-processed rocker arms with a roller are employed.
Figure 34:
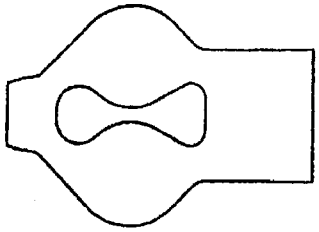
FIG. 34(a1) PRIOR ART
FIGS. 34(*a*1) through (*d*3) show a conventional shaping process of a roller mounting rocker arm, where FIGS. 34(*a*1), (*a*2) and (*a*3) are respectively a plan view, a front view, and a side view of a blanked piece, FIGS. 34(*b*1), (*b*2), and (*b*3) are respectively a plan view, a front view, and a side view of a rocker arm after folding process, FIGS. 34(*c*1) and (*c*2) are respectively a plan view and a front view of a rocker arm after drawing process for forming a roller mounting portion, and FIGS. 34(*d*1), (*d*2), and (*d*3) are respectively a plan view, a front view and a side view of a rocker arm after drawing process for forming a pivot engageable recess.
Figure 34:
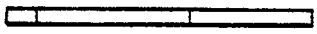
FIG. 34(a2) PRIOR ART
Figure 34:
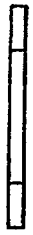
FIG. 34(a3) PRIOR ART
Figure 34:
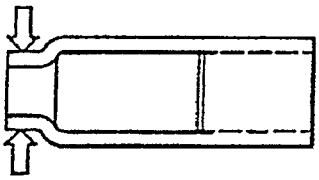
FIG. 34(b1) PRIOR ART
Figure 34:
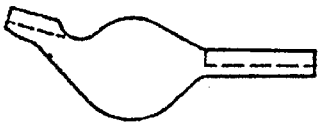
FIG. 34(b2) PRIOR ART
Figure 34:
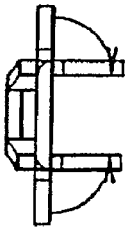
FIG. 34(b3) PRIOR ART
Figure 34:
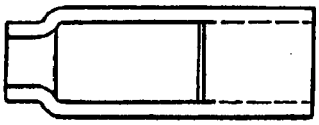
FIG. 34(c1) PRIOR ART
Figure 34:
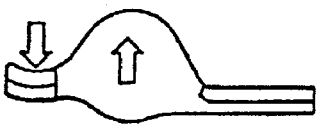
FIG. 34(c2) PRIOR ART
Figure 34:
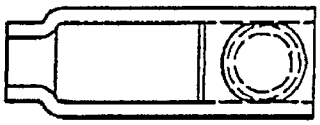
FIG. 34(d1) PRIOR ART
Figure 34:
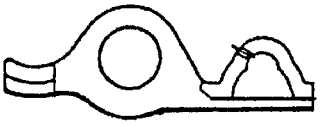
FIG. 34(d2) PRIOR ART
Figure 34:
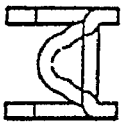
FIG. 34(d3) PRIOR ART

A roller mounting rocker arm according to the present invention is shown in FIG. 1, and is mounted on the cylinder head 1 shown in FIG. 33. To this cylinder head 1, a valve actuating mechanism is provided, which comprises a valve 2, a valve spring 3, a lash (or play) adjuster 4, a cam shaft 5 and a rocker arm 6. The rocker arm 6 mounts a roller 7 which engages with a cam 8 supported on the cam shaft 5. One end of the rocker arm engages with a pivot 4*a* of the lash adjuster 4, and the other end receives a valve stem 2*a* of the valve 2. Such a constituted valve actuating mechanism conducts opening and closing of inlet/exhaust ports 10 and 10' at a predetermined timing in such a manner that the rocker arm 6 pushes the top end face of the valve stem 2*a* by revolution of the cam 8 on the cam shaft 5, thereby the valve 2 projects into a combustion chamber 9 resisting the valve spring 3.

The above described roller mounting rocker 6 is made from a metal blank, and comprises a rocker arm body 11, roller 7, and valve stem receiving element 14. The rocker arm body 11 has a U shaped cross-section, and one end 11*a* of the rocker arm body connects to a connecting portion 12 on which a pivot engageable recess 12*a* which engages with the pivot 4*a* is formed by a drawing process. The cross-section of the pivot engageable recess has a shape such as would result from superimposing a small circle on the circumference of a large circle shown in FIGS. 3 and 4.

Figure 2:
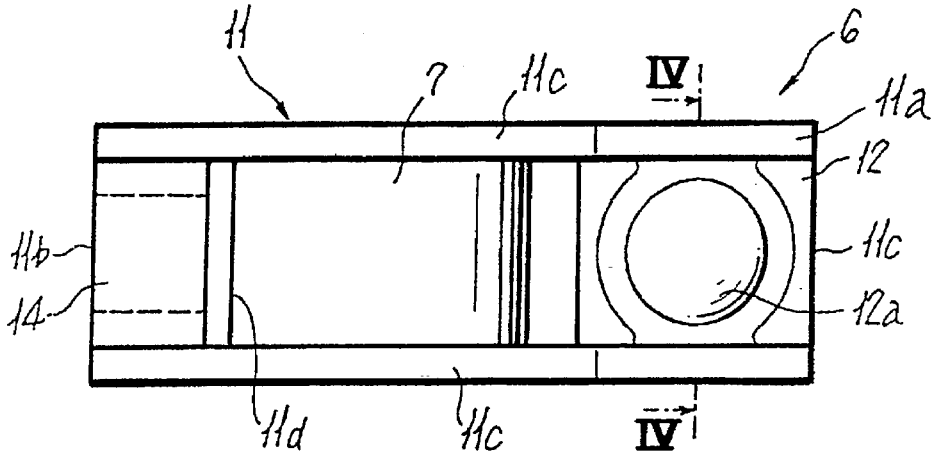
FIG. 2 is a plan view of the roller mounting rocker arm shown in FIG. 1.
Figure 5:
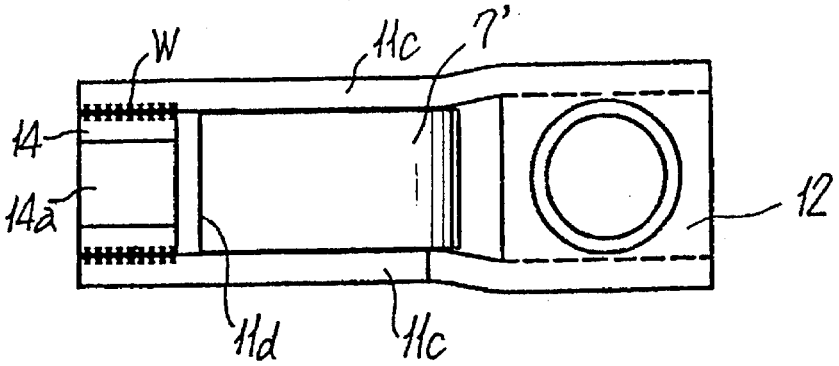
FIG. 5 is a bottom view of a modification of the first embodiment.

The other end 11*b* of the rocker arm body is open and the opening extends to the vicinity of the pivot engageable recess 12*a*. On both sides of the opening, side walls 11*c* extend in the longitudinal direction, which are shaped by folding a blanked metal plate, and each has a hole 13 for supporting a roller. At the end of the opening, a valve stem receiving element 14, which is shaped with another metal blank from the rocker arm body, is fixed between the side walls 11*c* by, for example, welding at the bottom faces (see FIGS. 2 and 5). In FIG. 5, letter W indicates the welding position.

Wear resistant material such as high Cr steel or ceramics is used for making the valve stem receiving element 14, to take into consideration the high contact force applied thereon. The valve stem receiving element 14 has a groove 14*a* on the bottom side for receiving a valve stem. The groove extends in the longitudinal direction of the rocker arm body, the width of which is designed to be substantially the same as the outer diameter of the valve stem 2*a*. Further, the inner upper surface 14*b* of the groove is round to allow for better engagement with the valve stem.

Figure 3:
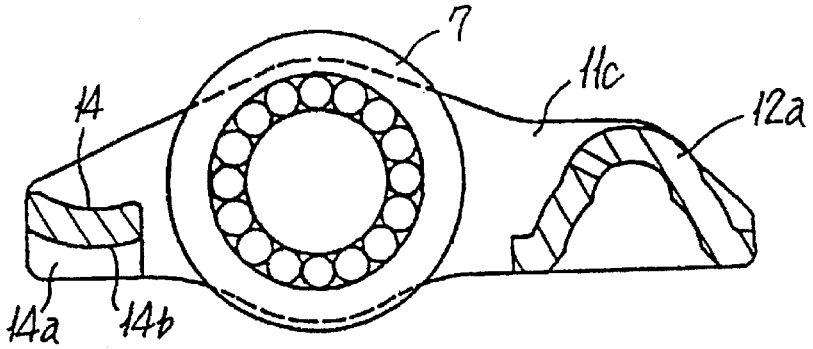
FIG. 3 is a cross-sectional view of the roller mounting rocker arm shown in FIG. 1.
Figure 4:
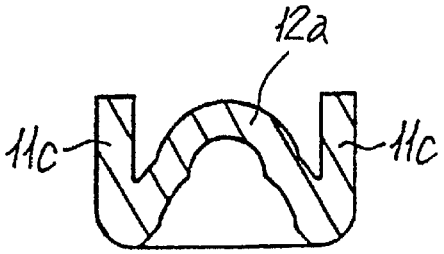
FIG. 4 is a cross-sectional view taken along line IV—IV in FIG. 2.

Between the valve stem receiving element 14 and the pivot engageable portion 12*a*, a roller 7 is rotatably supported on an axle 15 between the side walls 11*c* (that is, in a roller mounting opening 11*d*). A plurality of needle roller bearings are employed in the roller 7 as shown in FIG. 3 in order to reduce localised abrasion or noise caused by engagement of the cam 8 with the bearing.

A method for manufacturing a roller mounting rocker arm including the above constituted rocker arm body will now be described referring to FIG. 6.

Firstly, at a blanking process, a metal plate is blanked into a predetermined shape which can be developed into the rocker arm body 11. This blanked metal has a U shape comprising two wings and a connecting portion, each of the wings having a hole and outwardly expanding around the hole, as shown in FIGS. 6(*a*1) and 6(*a*2). The maximum distance between the two wings corresponds to the maximum width of the roller 7 which is to be mounted.

Figure 6:
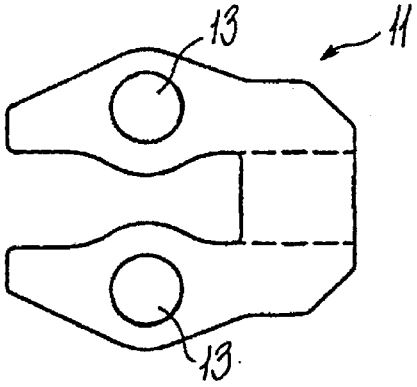
FIGS. 6 (*a*1)–(*d*2) show a shaping process of the rocker arm according to the first embodiment, where (*a*1) and (*a*2) are a plan view and a side view, respectively, of a blanked metal for shaping a rocker arm, (*b*1) and (*b*2) are a plan view and a side view respectively of a folded rocker arm body, (*c*1) and (*c*2) are a plan view and a side view respectively after a drawing process for forming a pivot engageable recess, and (*d*1) and (*d*2) are respectively a plan view and a side view after a process for forming a valve stem receiving portion.
Figure 6:
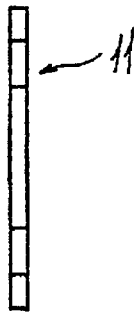
Figure 6:
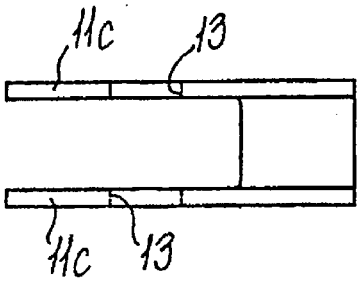
Figure 6:
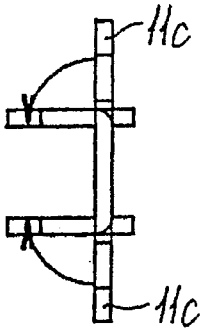
Figure 6:
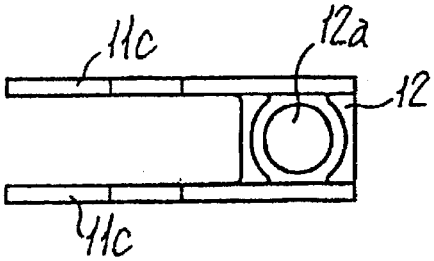
Figure 6:
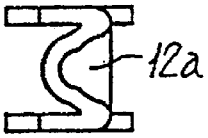
Figure 6:
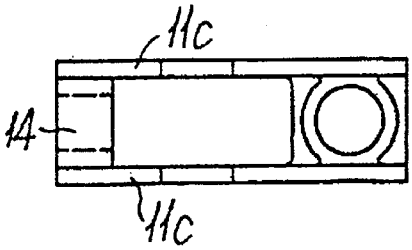
Figure 6:
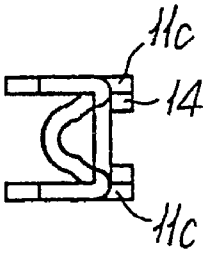
Figure 7:
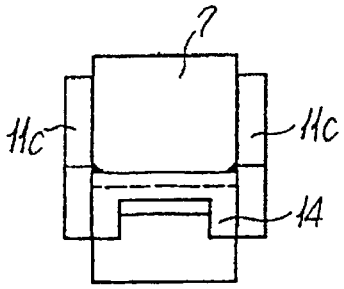
FIG. 7 is a side view of a modification of the valve stem receiving element, showing a welding surface.

Then, at the folding process shown in FIGS. 6(*b*1) and 6(*b*2), the two wings of the blanked metal which constitute the rocker arm body 11 are upwardly folded to form side walls 11*c* with an opening width so that the cross-section becomes a U-shape, and the holes formed on both side walls during the blanking process are coaxial.

At the drawing process shown in FIGS. 6(*c*1) and 6(*c*2), the connecting portion which connects the side walls 11*c* is upwardly drawn to form a pivot engageable recess 12*a* projecting from the connecting portion into the clearance between the side walls.

Further, at the engaging process shown in FIGS. 6(*d*1) and 6(*d*2), a valve stem receiving element 14 which has been shaped beforehand is fixed between the side walls at the other end portion.

Finally, a roller 7 is mounted in the roller mounting portion 11*d* from the upper opening of the rocker arm body 11, and fixed between the side walls 11*c* with an axle inserted into the hole 13.

In the case that the width of the roller 7 is smaller than that of the connecting portion 12, the side walls 11*c* can be bent as shown in FIG. 5 so as to narrow the width between the walls to the desired distance. Thus, the rocker arm of the present invention can be adaptable to a roller 7' hating a different width.

Figure 8A:
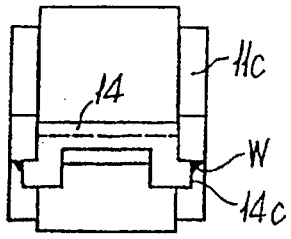
FIGS. 8(*a*) and 8(*b*) show a modification of the roller mounting rocker arm of the first embodiment, where FIG. 8(*a*) is a side view and FIG. 8(*b*) is a front view of the roller mounting rocker arm.
Figure 8B:
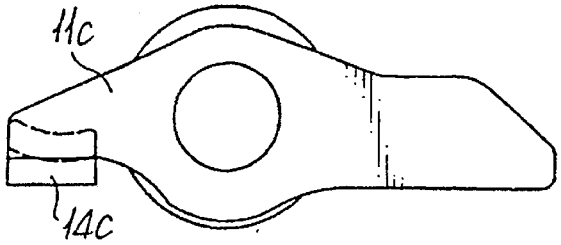

In this embodiment, the valve stem receiving element 14 is fixed by welding at the bottom face, however, it may be fixed by welding at the top face. The valve stem receiving element may also fixed very firmly by being shaped in a manner that a portion of its side faces 14*c* project toward the side walls 11*c* so as to be thickly welded to the bottom faces of the side walls 11*c* as shown in FIG. 8(*a*). The holes 13 may be formed after fixing the valve stem receiving element (i.e. after the engaging process shown in FIG. 6(*d*1)).

Now, a second embodiment will be described in which the roller mounting rocker arm of FIG. 1 is modified in several ways.

Figure 9A:
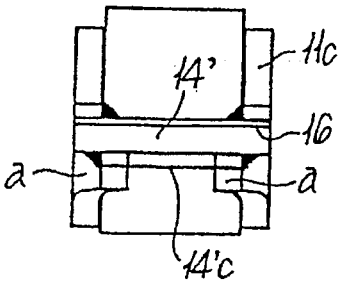
FIG. 9(*a*) and 9(*b*) show a roller mounting rocker arm according to the second embodiment, where FIG. 9(*a*) is a side view and FIG. 9(*b*) is a front view of the roller mounting rocker arm.
Figure 9B:
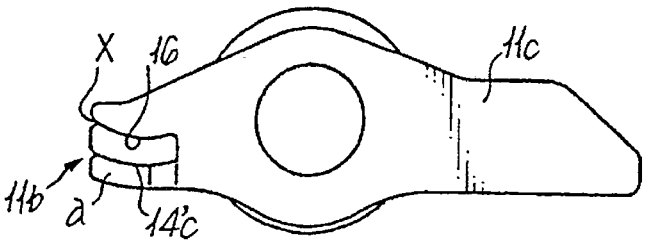
Figure 10A:
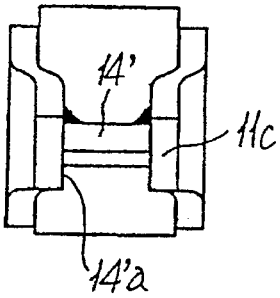
FIGS. 10(*a*) and 10(*b*) as well as 11(*a*) and 11(*b*) show modifications of the roller mounting rocker arm of the second embodiment, where each (*a*) is a side view and each (*b*) is a front view of the roller mounting rocker arm.
Figure 10B:
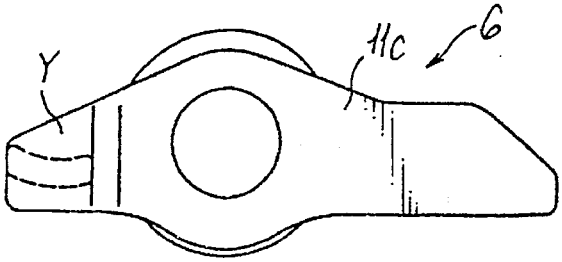
Figure 11A:
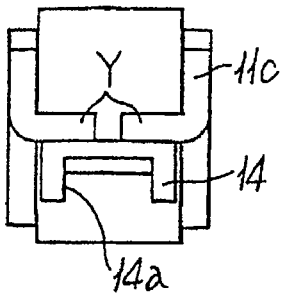
Figure 11B:
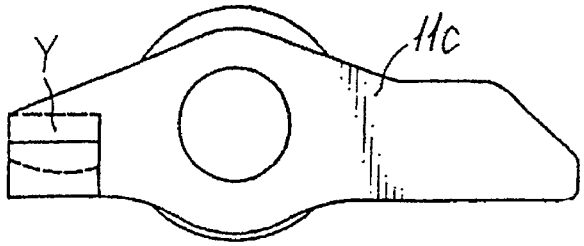

Each of the modifications are shown in FIGS. 9–11, where the side walls 11*c* of the first embodiment are respectively modified. In FIG. 9, a groove 18 is formed at the end portion X of the side walls 11*c*, that is, at the valve stem receiving side 11*b*. The groove 16 is shaped at the blanking process shown in FIG. 6(*a*1), into which the valve receiving element 14' not having a groove 14*a* is fixed. The width of the valve stem receiving element 14' corresponds to the width between the outer face of the side walls 11*c*, and its bottom face is made round. The valve stem receiving element 14' is made from a wear resistant material.

A portion "a" of each of the side walls 11*c* positioned below the groove 16 is drawn so that they become close to each other. The top face of the valve stem receiving element 14' is fixed by welding to the inner face of the side walls 11*c*, while the lower face 14*c* thereof is welded to the outer face of the portion "a". Thus, a groove 14' a is formed with the bottom face of the valve stem receiving element 14' and the portion "a" of the side walls.

In FIG. 10, the end portion Y of the side walls 11*c* are integrally drawn to be close to each other, and to the narrowed space between the side walls 11*c*, a valve stem receiving element 14' is fixed so as to form a groove 14'*a* with the bottom face of the valve stem receiving element 14' and the side walls 11 for receiving a valve stem.

In FIG. 11, there shown another modification of the roller mounting rocker arm. The end portion Y of the side walls 11*c* is inwardly folded by a right angle, to which a valve stem receiving element 14 having a groove 14*a* is welded.

As mentioned above, the width of the valve stem receiving portion can be easily adjusted by modifying the side walls 11*c*, and the variation of fixing manner is broad. Although, in these rocker arm bodies, valve stem receiving portions are formed by welding a valve stem receiving element, which has been separately shaped, onto the side walls, it may be integrally shaped with the side walls by folding both end portions Y so as to directly weld them to each other, or by extending either end portion Y to the other side where they are welded to each other.

Next, The third embodiment of the roller mounting rocker arm will now be described with reference to FIGS. 12–17. In this embodiment, the valve stem receiving element is modified so as to have a shaft-like or a bolt-like shape, and fixed between the side walls.

Figure 12A:
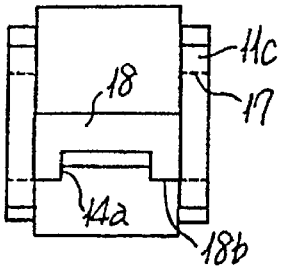
FIGS. 12(*a*) and 12(*b*) show a roller mounting rocker arm according to the third embodiment, where FIG. 12(*a*) is a side view and FIG. 12(*b*) is a front view of the roller mounting rocker arm.
Figure 12B:
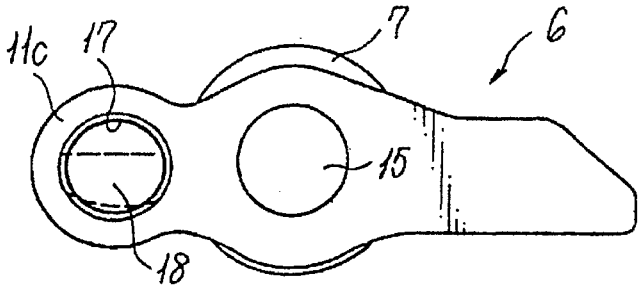
Figure 15:
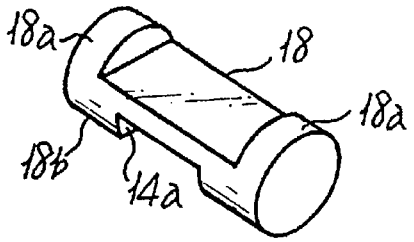
FIG. 15 is a perspective view of the valve receiving element of FIG. 12(*a*)

In FIG. 12(*b*), a hole 17 is pierced in the side walls 11*c* of the roller mounting rocker arm 6. (In the drawings, it appears at the left of the axle 15 supporting a roller 7.) The holes are formed at the initial blanking process of the rocker arm body shown in FIG. 8. A shaft-like valve stem receiving element 18 is supported in the holes 17. As shown in FIG. 15, both ends 18*a* of the shaft-like element are cylindrical, and are to be fixed into the holes 17, and between the cylindrical ends, the upper surface is scooped out to make a planar surface which is to be positioned between the side walls. On the lower curved surface 18*b* of the shaft-like element, a groove 14*a* is formed for receiving a valve stem. This shaft-like valve stem receiving element is fixed between the side walls by caulking the both ends 18*a* into the holes 17 of the side walls 11*c*.

Figure 13A:
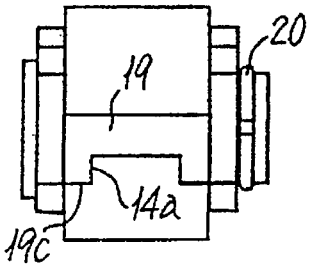
FIGS. 13(*a*) and 13(*b*) as well as 14(*a*) and 14(*b*) show modifications of the third embodiment, where each (*a*) is a side view and each (*b*) is a front view of the roller mounting rocker arm.
Figure 13B:
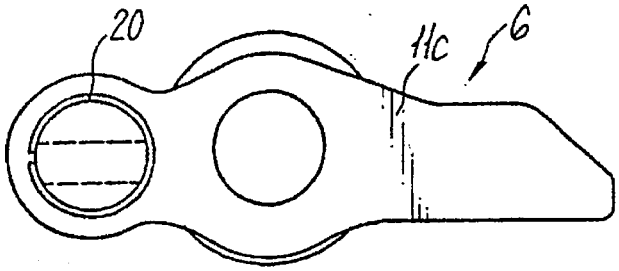
Figure 16:
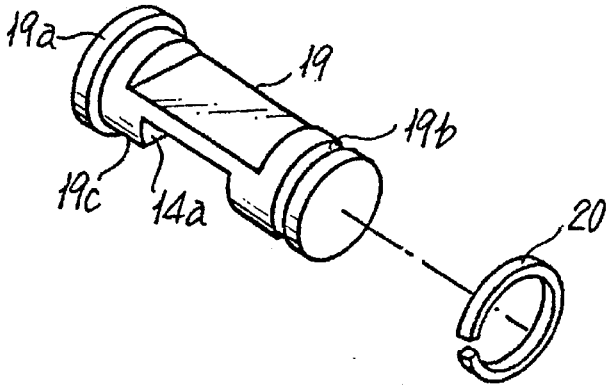
FIG. 16 is a perspective view of the valve stem receiving element of FIG. 13(*a*)
Figure 18A:
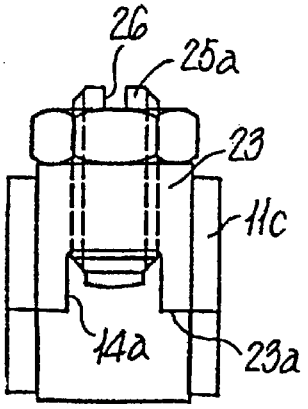
FIGS. 18(*a*) and 18(*b*) show another modification of the roller mounting rocker arm of the third embodiment where FIG. 18(*a*) is a side view and FIG. 18(*b*) is a front view of the roller mounting rocker arm.
Figure 18B:
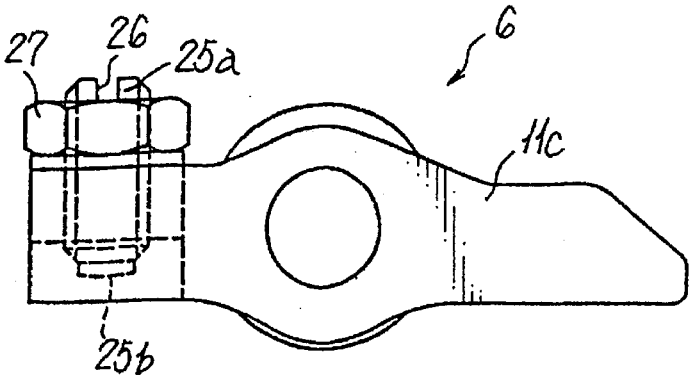

In FIG. 13, a shaft-like valve stem receiving element 19 is fixed to the holes 17 with a snap ring 20, the detailed composition of which is shown in FIG. 18. As illustrated in FIG. 16, the valve stem receiving element 19 has a cylindrical head 19*a* on one end, and a groove 19*b* is cut on the other end along its circumference, to which a snap ring 20 is engaged to restrain the movement of the valve stem receiving element in the axial direction. The upper middle portion of the element 19, which is to be positioned between the side walls, is scooped out into a planar surface in the same manner as the shaft-like element 18 of FIG. 15, and the lower surface 19*c* of the element 19 has a groove 14*a*.

Figure 14A:
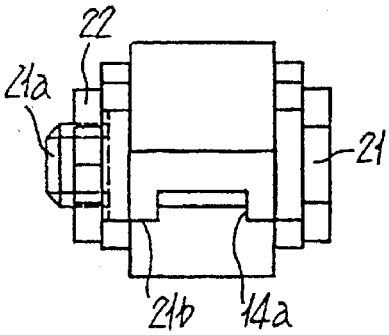
Figure 14B:
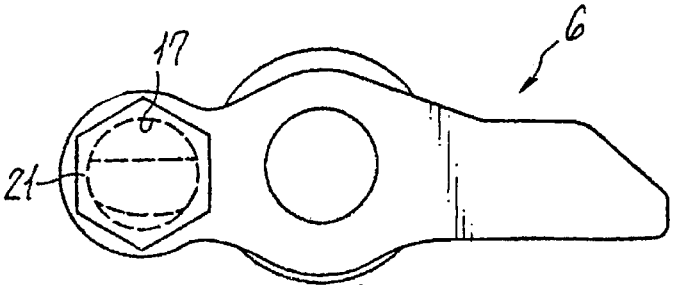
Figure 17:
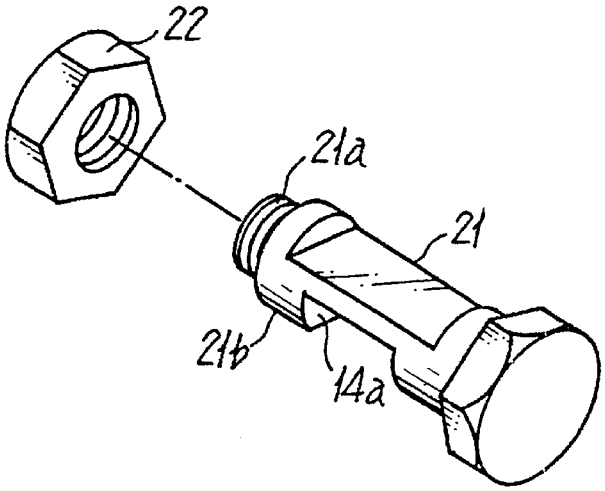
FIG. 17 is a perspective view of the valve stem receiving element of FIG. 14(*a*)

In FIG. 14, a bolt-like valve stem receiving element 21 shown in FIG. 17 is inserted from the hole 17 of the roller mounting rocker arm 6. One end 21*a* of the element 21 is screw-cut and its diameter is made smaller, on which a nut 22 is screwed to fix the element 21 to the side walls 11*c*. As with the shaft-like valve stem receiving elements 18 and 19, a groove 14*a* is formed on the lower curved surface 21*b* for receiving a valve stem.

Thus, by shaping a valve stem receiving element into a shaft-like form or a bolt-like form, fixture to the side walls 11*c* can be simplified. Further, in such a type of valve stem receiving element as is fixed by a nut or a ring, the position of the groove 14*a* for receiving a valve stem can be adjusted in the axial direction by only adjusting the ring-engaging position or screw of the nut.

Figure 19:
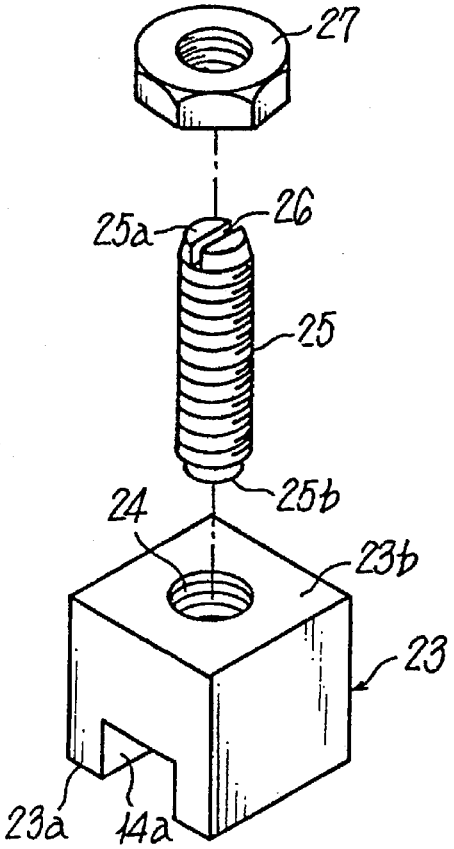
FIG. 19 is a perspective view of the valve stem receiving element of FIG. 18(*a*), illustrating its structure.

In FIGS. 18(*a*), and 18(*b*) a valve stem receiving element 23 having a mechanism for adjusting a clearance to the valve stem 2*a* is provided to the roller mounting rocker arm 8. As shown in FIG. 19, the valve stem receiving element 23 is a cubic shape, on the bottom face 23*a* of which a groove 14*a* is formed, and its height is greater than that of the side walls 11*c*. This cubic valve stem receiving element is welded between the side walls 11*c*. On the top face 23*b* of the valve stem receiving element 23, a screw hole 24 is formed toward the groove 14*a*. A screw bar 25 is screwed from the screw hole 24 up to the groove 14*a*. A slit 26 is formed on one end 25*a* of the screw bar 25, to which a lock nut 27 is screwed, and the other end 25*b* is spherically shaped.

According to this structure, clearance adjustment in the vertical direction between the valve stem 2*a* and the screw bar 25 can be easily realised by loosening the lock nut 27 and screwing the screw bar 25 to adjust the projecting amount of the screw 25 into the groove 14*a*.

As described above, since the rocker arm body has a U-shaped cross-section and only one end of the side walls 11*c* are connected to each other by the connecting portion 12 with the other end being open, the width of the roller inserting portion is freely set by adjusting the folding degree of the side walls. Further, since the valve stem receiving element is separately shaped from the rocker arm body as having a groove for receiving a valve stem, the width of the groove is easily changed to adjust the valve stem receiving portion, and also the material of only this part can be changed into wear resistant material to improve the rigidity of this portion without much expense.

Now we will describe the fourth embodiment of the roller mounting rocker arm, in which the connecting portion around the pivot engageable recess is modified.

The roller mounting rocker arm 6 shown in FIG. 20–24 has a basic structure almost the same as that of the embodiments 1–3, in which a roller 7 is rotatably mounted on the rocker arm body 11. The rocker arm body 11 is shaped by blanking a metal plate into a predetermined shape and by folding into a U-shape, which comprises two side walls 11*c* substantially parallel to each other, a connecting portion 12 which connects the side walls at one end of the longitudinal direction, and a valve stem receiving element 14 which has been separately shaped and is welded to the other end of the side walls. A hemispherical pivot engageable recess 12*a* is formed by drawing on the connecting portion 12 so as to project into the clearance between the side walls.

Figure 20:
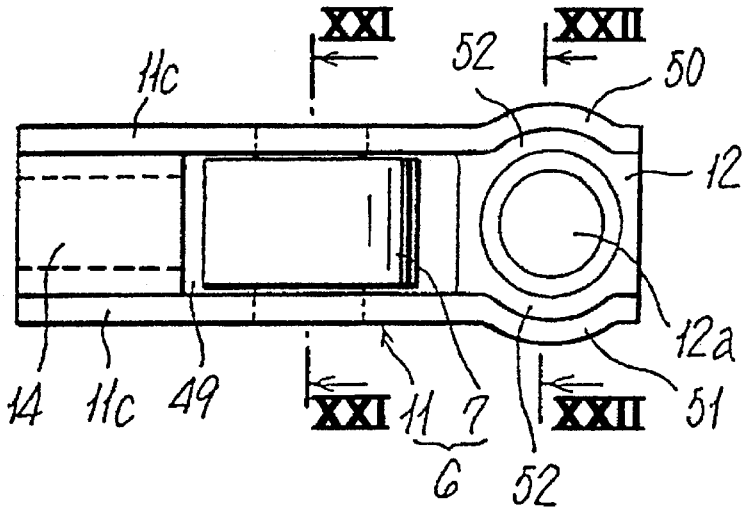
FIG. 20 shows a plan view of a roller mounting rocker arm of the fourth embodiment.

The side walls 11*c*, at the connecting portion, outwardly expand along the outer circumference of the pivot engageable recess as illustrated with the numerals 50 and 51 in FIG. 20.

A roller 7 is rotatably supported by an axle between the pair of side walls 11*c* of the rocker arm body 11, and slightly projects from a rectangular opening 49 defined by the side walls 11*c*, a connecting portion 12 and valve stem receiving element 14.

The rocker arm body 11 of the fourth embodiment is manufactured by blanking a metal plate into a predetermined shape as shown in FIG. 23(*a*), then upwardly folding the two wings along the dashed line in FIG. 23(*a*) so as to have a U-shaped cross-section, the plan view of which is shown in FIG. 23(*b*), and forming a hemispherical pivot engageable recess 12*a* by drawing in the middle of the connecting portion 12 as shown in FIG. 23(*c*), and finally welding an individually shaped valve stem receiving element 14 having an inverted U-shaped cross section as shown in FIG. 23(*d*).

A feature of the rocker arm body 11 of the fourth embodiment resides in the flat planar face 52 provided along the circumference of the pivot engageable recess 12 and between the curved side walls 50 and 51 (which is a part of the side walls 11*c*). The curvature of the curved side walls is identical to that of the outer circumference of the pivot engageable recess. This flat face surrounding the pivot engageable recess is for receiving a cylindrical mold 53 employed for shaping the pivot engageable recess 12*a*, thereby preventing plastic deformation of the side walls which could be caused during the drawing process of the pivot engageable recess. Further, even after the subsequent heating process of the rocker arm body, the spherical form of the pivot engageable recess can be substantially maintained keeping the preciseness at the drawing process, because the degree of distortion is substantially constant around the pivot engageable recess.

Figure 21:
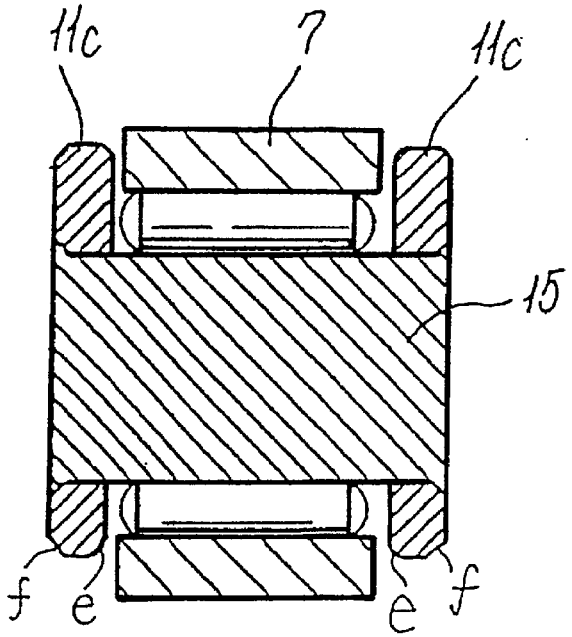
FIG. 21 is an enlarged sectional view taken along line XXI—XXI in FIG. 20.
Figure 22:
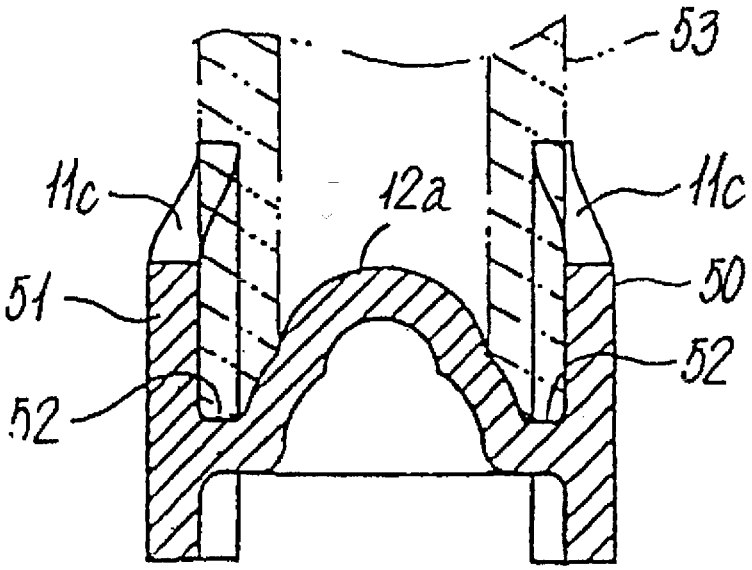
FIG. 22 is an enlarged sectional view taken along line XXII—XXII in FIG. 20.
Figure 23A:
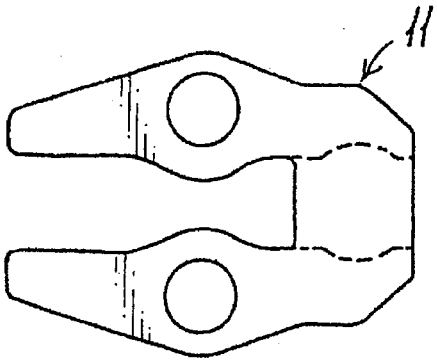
FIGS. 23(*a*), 23(*b*), 23(*c*), and 23(*d*) illustrate schematic plan views of the rocker arm, showing the shaping process in the fourth, fifth, and sixth embodiments, where FIG. 23(*a*) shows a blanked metal after blanking process, FIG. 23(*b*), FIG. 23(*c*) and FIG. 23(*d*) show rocker arm bodies respectively after a folding process, drawing process, and engaging process for valve stem receiving portion.
Figure 23B:
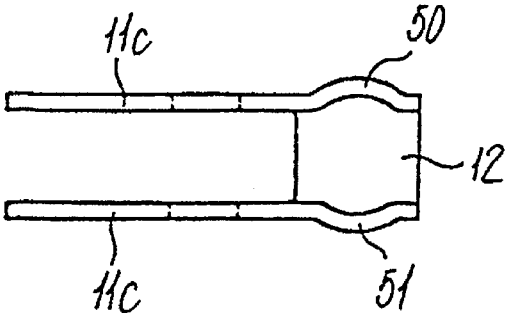
Figure 23C:
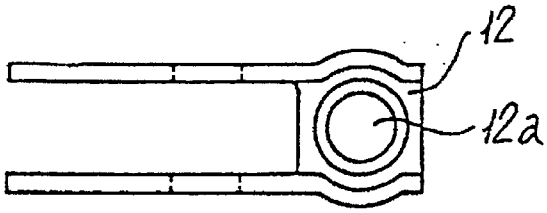
Figure 23D:
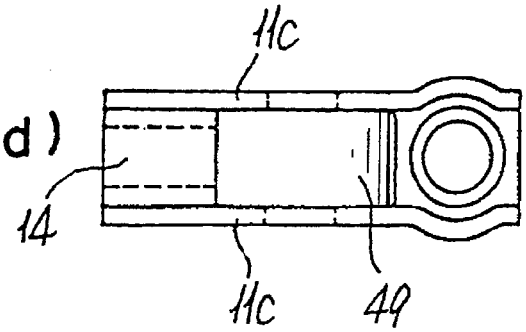
Figure 24:
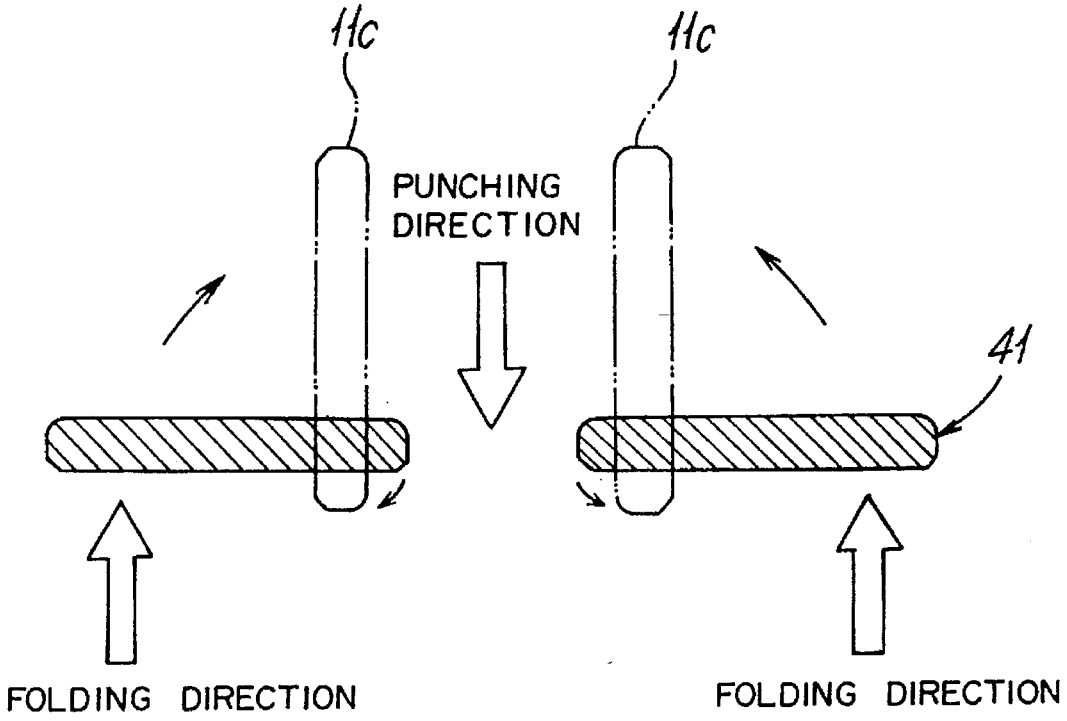
FIG. 24 shows punching direction at metal-blanking and folding direction of the rocker arm according to the fourth embodiment.

Another feature of the fourth embodiment is that the inner edge of the side walls 11*c* (indicated with a letter e) is round as shown in FIG. 21. Normally, at the stage of blanking a metal plate, the blanked edge of the top face becomes rounded as shown in FIG. 24. In this embodiment, the side walls are folded in the opposite direction to the punching direction so that the rounded edges are positioned inside while the angular edge "f" of the ruptured bottom face is to be an outer edge of the side walls.

Figure 25:
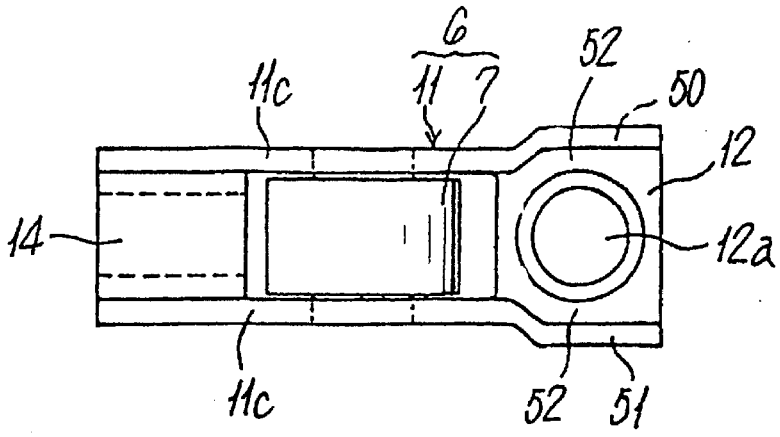
FIG. 25 shows a modification of the fourth embodiment shown in FIG. 20.
Figure 26:
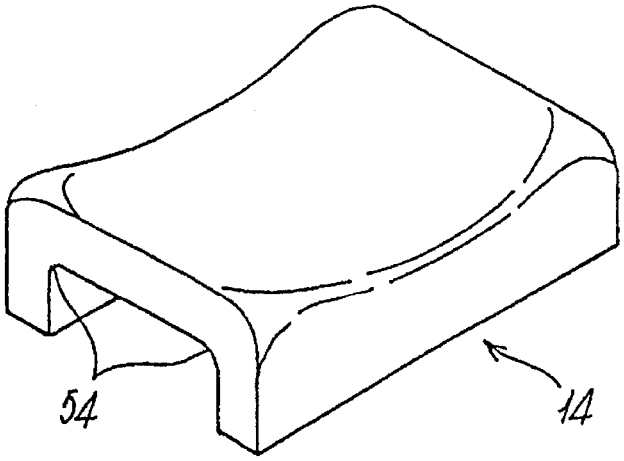
FIG. 26 is a perspective view of the valve stem receiving element of the roller mounting rocker arm of the fifth embodiment.
Figure 27A:
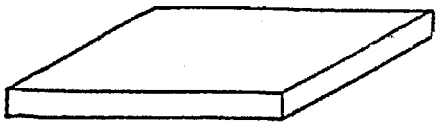
FIGS. 27(*a*), 27(*b*), 27(*c*), and 27(*d*) illustrate the process of making the valve stem receiving element of FIG. 16, where FIG. 27(*a*) shows a blank material, FIG. 27(*b*) shows a folded blank, FIG. 27(*d*) shows a warping-processed valve stem receiving element, and FIG. 27(*c*) shows a plan view of the valve stem receiving element for explanation of areas on the upper surface thereof.
Figure 27B:
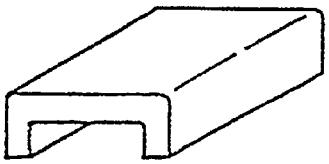
Figure 27C:
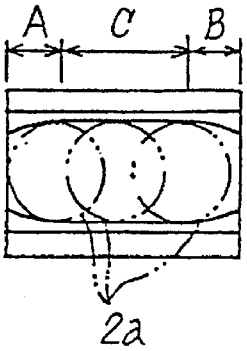
Figure 27D:
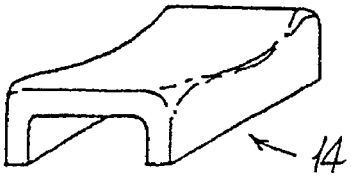

It should be understood that the present invention is not limited to the above embodiment. The overall shape of the rocker arm body 11 is optional, and a plurality of needle roller bearings need not necessarily be mounted between the roller 7 and the axle 15. Although, in this embodiment, the valve stem receiving element is separately shaped from the rocker arm body 11, it may be integrally shaped with the rocker arm body. Further, the expanded portions 50 and 51 may be parallel to each other as shown in FIG. 25. The roller may by made from ceramics mainly composed with silicon nitride, or from bearing steel.

As described above, in the fourth embodiment, the degree of distortion is substantially constant at any point of the surroundings of the pivot engageable recess because the planar face provided therearound, and the inner shape of the pivot engageable recess can be kept accurate even after the heating process. Consequently, the pivot engageable recess can receive the pivot of the lash adjuster with a large contact area, which results in small contact stress between the two and reduce wear. Besides, the swing fulcrum of the rocker arm is immobile and the movement of the rocker arm is stable. As a result, the timing of opening and closing of the valve can be kept accurate and the reliability is improved.

Further, since the inner edges of the side walls are made round and smooth to reduce the wear resistance, even in the case that the roller touches the side walls, the roller is prevented from being damaged without abnormal noise. Thus, the durability of the roller mounting rocker arm is improved and its movement is stable, which contributes to reliability of the products.

The fifth embodiment of the roller mounting rocker arm will now be described referring to FIGS: 26–28, in which a modification of the valve stem receiving element is shown. In this modification, the valve stem receiving element 14 is individually shaped separate from the rocker arm body 11 (See FIG. 2), and the inner corners 54 are made round in the longitudinal direction of the element. The radius of the curvature at the both ends of the inner corners is different from that of the middle corner. That is, the radius of curvature at the middle corner is set small (but not so small as interfere with the valve stem 2*a*), while that at the end corners is set great (but not so great as break the element during the warping process). The radius of curvature gradually increases from the middle toward the end along the corners as shown in FIG. 27(*c*) in consideration of the form of the top face of the valve stem 2*a*.

The end portion in the longitudinal direction of the valve stem receiving element indicates the area A and B in FIG. 27(*c*), and the middle portion is the area C in FIG. 27(*c*).

Such a valve stem receiving element 14 is manufactured by folding a square metal plate (as shown in FIG. 27(*a*)) with a receiving mold (not shown) so as to have an inverted U-shaped cross section (See FIG. 27(*b*)). The upper corners of the receiving mold, which correspond to the inner corners of the valve stem receiving element 14, are made round, and this round shape is copied to the inner corners of the valve stem receiving element. Under the folding process, the radius of curvature of the inner corners is made different between the the middle portion C and the end portions A and B of the corners as shown in FIG. 27(*c*). Then, the top wall of the valve stem receiving element 14 is warped so as to become concave at its middle portion. The stress is apt to concentrate to both ends of the inner corners 54, however, in this embodiment, the stress is dispersed and the concentration of stress is avoided because the radius of curvature gets greater toward the end portion.

Figure 28:
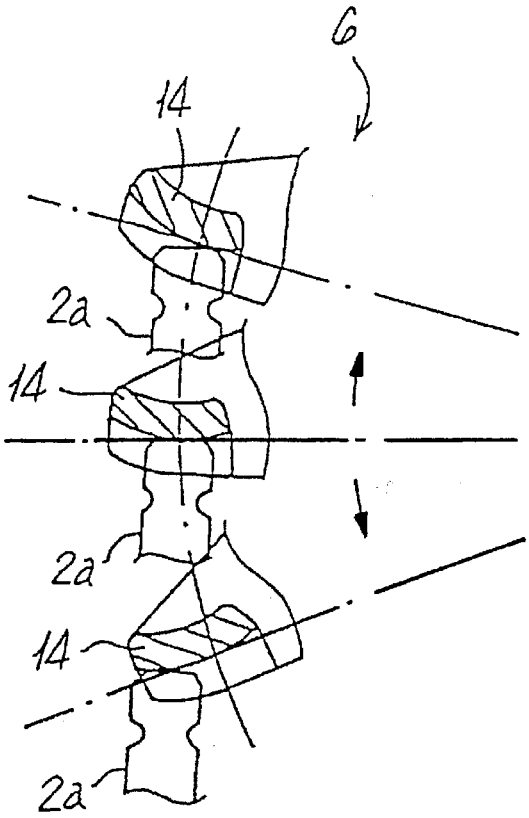
FIG. 28 shows engaging states of the valve stem with the valve stem receiving element of the rocker arm of the fifth embodiment.
Figure 29:
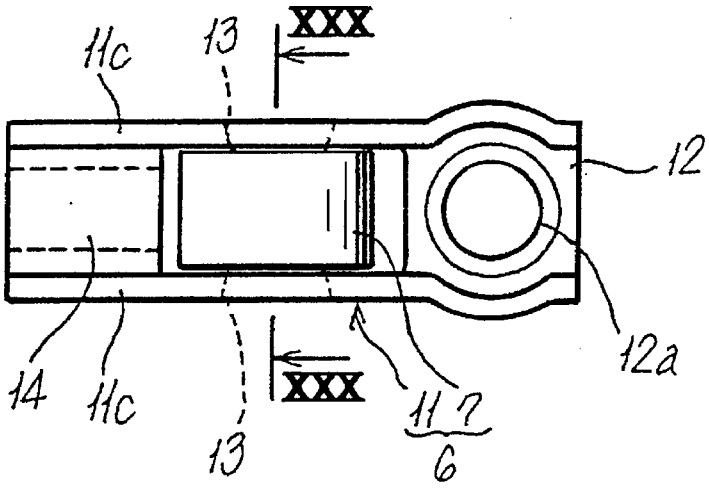
FIG. 29 is a plane view of a roller mounting rocker arm of the sixth embodiment.

During the swing motion of the rocker arm on a fulcrum of the pivot engageable recess 12*a*, when the valve stem receiving element is at a horizontal position, it receives the valve stem 2*a* in its middle area C, while at a slanted position (backwardly or forwardly), it receives the valve stem in its end area A or B, as shown in FIG. 28. In either case, the inner corners 54 of the valve stem receiving element 14 do not interfere with the edge of the top face of the valve stem 2*a*.

Thus, in this embodiment, the curvature of the inner corner of the valve stem receiving element is set different depending on the position in the longitudinal direction in order to avoid the interference with the top edges of the valve stem, and to disperse the tension stress caused during the warping process for preventing breakage of the element.

A rocker arm thus designed is superior both in function and ease of manufacture.

Figure 30:
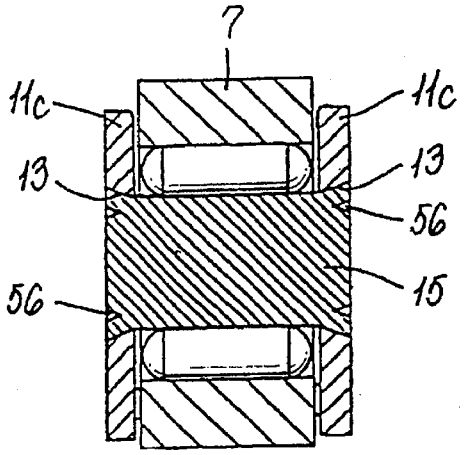
FIG. 30 is an enlarged sectional view taken in XXX—XXX line in FIG. 29.
Figure 31:
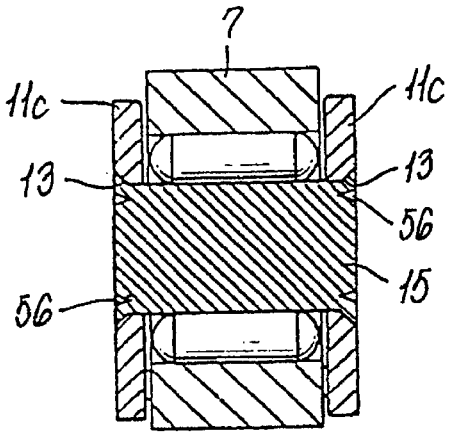
FIG. 31 shows a modification of the roller mounting rocker arm of the sixth embodiment, which corresponds to FIG. 30.

Now, the sixth embodiment of the roller mounting rocker arm will be described referring to FIG. 29–32. In this embodiment, the holes 13 formed coaxially on the side walls 11*c* are modified. The outer diameter of the axially hole 13 as a roller support is set greater than the axially inner diameter thereof. In FIG. 30, the diameter of the hole gets greater from the inner surface toward the outer surface of the side wall so as to have a conical surface, while in FIG. 31, the hole is cylindrical up to the half thickness of the side wall, and then increases its diameter toward the outer surface. By stamping the end face of the axle inserted in the hole 13 with jigs having a cone point, the triangle clearance between the axle 15 and the inner surface of the extending hole is closed as the periphery of the end face of the axle expands by plastic deformation caused by the jigs. In the drawings, the numeral 56 indicates the mark caused by the jigs. The clearance between the axle and the conical face of the hole allows a large extent of plastic deformation of the end faces of the axle caused by stamping, which prevents loosening of the axle caused by vibration under use. As a result, the axle 15 does not easily come out of the hole.

Figure 32:
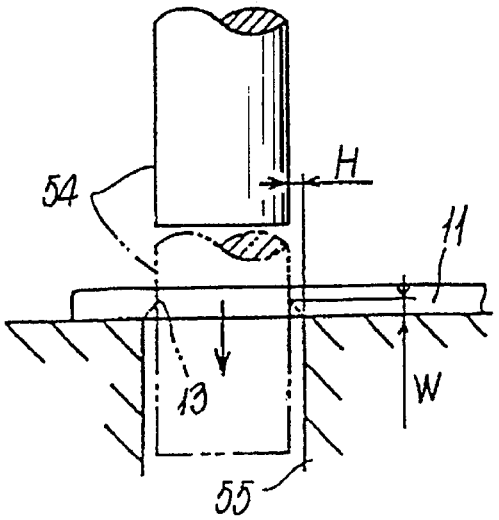
FIG. 32 is a schematic view of the roller supporting portion of the sixth embodiment for explanation of the forming of a hole.

An example of a method for forming a hole 13 will be described referring to FIG. 32. The hole 13 is shaped with a punch 54 at the initial blanking process of the rocker arm body 11. By adjusting a difference H between the diameter of the punch 54 and that of the receiving mold 55, the thickness W of the conical portion of the hole 13 can be varied. The thickness W becomes greater with increase of the difference H. In addition, the thickness W can be adjusted by specifying the hardness of the metal plate because it varies depending on the hardness of the material.

Thus, the axle is steadily fixed into the conical holes by caulking the end faces of the axle to outwardly expand the circumference, without the possibility of loosening by vibration under use, which improves reliability of the product.

It should be appreciated that the present invention is not limited to the foregoing embodiments and various changes and modifications are included within the scope and the principle of the present invention, which will be understood by those skilled in the art.

Industrial Applicability

This roller mounting rocker arm and the method for manufacturing the same is effectively utilized in an engine having an OHC type valve actuating mechanism. Especially when employed in an automobile engine which requires durability and mass-productivity as well as cost reduction, it gives full effect.

We claim:

1. A roller rocker arm comprising:

a rocker arm body including a pair of side walls and a connecting portion, the side walls being connected by the connecting portion at one end thereof and being open at the other end thereof with a middle portion therebetween the side walls extending substantially parallel to each other from the middle portion to the other end with a predetermined space kept between the side walls;

a roller member rotatably positioned in the middle of the space between the side walls of the rocker arm body;

a pivot engaging portion engageable with a pivot, the pivot engaging portion projecting from the connecting portion into the space between the side walls, the pivot engaging portion being completely surrounded by a flat planar surface; and valve stem receiving means disposed at the open end of the rocker arm body so as to come into contact with a valve stem, the valve stem receiving means being a separate element from the rocker arm body;

wherein the roller rocker arm body is closed by the valve stem receiving means coupled to the side walls and each of the side walls includes of the flat planar surface so that a distance between the side walls at the pivot engaging portion is greater than a distance at the other end and the middle portion.

2. The roller rocker arm as in claim 1, wherein the pivot engaging portion is semi-spherical.

3. The roller rocker arm as in claim 1, wherein the outwardly extending portions are substantially concentric with the pivot receiving portion.

4. The roller rocker arm as in claim 1, wherein the outwardly extending portions are substantially in parallel with the side walls.

5. A roller rocker arm comprising:

a rocker arm body including a pair of side walls and a connecting portion, the side walls extending substantially parallel to each other with a predetermined space kept therebetween, the side walls being connected by the connecting portion at one end thereof and being open at the other end thereof;

a first horizontal surface configured on the other end of the rocker arm body, the first horizontal surface being orthogonal to the side walls and parallel to a longitudinal axis of the rocker arm body;

a roller member rotatably positioned in the middle of the space between the side walls of the rocker arm body;

a pivot engaging portion engageable with a pivot, the pivot engaging portion projecting from the connecting portion into the space between the side walls;

valve stem receiving means disposed at the open end of the rocker arm body so as to come into contact with a valve stem, the valve stem receiving means being a separate element from the rocker arm body;

a second horizontal surface configured on the valve stem receiving means, the second horizontal surface being orthogonal to the valve stem;

wherein the valve stem receiving means is attached to the rocker arm body via the first and second horizontal surfaces.

6. The roller rocker arm as in claim 5, wherein the first and second horizontal surface are welded.

7. The roller arm as in claim 5, wherein at least one of the side walls further includes a groove configured thereon and the first horizontal surface is configured within the groove.

8. The roller rocker arm as in claim 5, wherein the first horizontal surface is configured by bending at least one of the side walls towards the space therebetween.

* * * * *